United States Patent [19]

Bubley

[11] Patent Number: 4,841,854

[45] Date of Patent: Jun. 27, 1989

[54] ADJUSTABLE SQUEEGEE APPARATUS

[75] Inventor: Henry J. Bubley, Deerfield, Ill.

[73] Assignee: American Screen Printing Equipment Company, Chicago, Ill.

[21] Appl. No.: 106,753

[22] Filed: Oct. 6, 1987

[51] Int. Cl.[4] ..... B41F 15/44

[52] U.S. Cl. ..... 101/123

[58] Field of Search ..... 101/123

[56] References Cited

U.S. PATENT DOCUMENTS

| | | | |
|---|---|---|---|
| 4,023,486 | 5/1977 | Linthicum et al. | 101/123 |
| 4,121,519 | 10/1978 | Porth | 101/123 |
| 4,648,317 | 3/1987 | Bubley et al. | 101/123 |

FOREIGN PATENT DOCUMENTS

| | | | |
|---|---|---|---|
| 376083 | 5/1964 | Switzerland | 101/123 |

*Primary Examiner*—Edgar S. Burr

*Assistant Examiner*—James Lisehora

*Attorney, Agent, or Firm*—Fitch, Even, Tabin & Flannery

[57] ABSTRACT

A squeegee assembly is provided with selectively adjustable stiffness for the squeegee blade to control the deflection of the squeegee blade and thereby the position of the leading edge of the blade when it is under pressure and forcing ink through a screen printing fabric. The preferred adjustment is achieved by a vertically movable clamp having front and rear plates engaging the front and rear faces of the squeegee blade. The clamp is moved up or down the squeegee blade to adjust the stiffness of the blade by moving the plates vertically. Preferably, the plates are at a fixed spacing with a lower end on the rear plate located below the lower end of the front plate. Fasteners clamp the plates to an upper holder and clamp the lower ends of the plates against the squeegee blade.

8 Claims, 2 Drawing Sheets

ADJUSTABLE SQUEEGEE APPARATUS

BACKGROUND OF THE INVENTION

1. Field of the Invention

The present invention pertains to squeegees used in screen printing and in particular to squeegee assemblies and the stiffness of the squeegee blade used therein.

2. Description of the Prior Art

In many known types of manually and automatically operated screen printing apparatus, a squeegee is used to distribute ink across the screen and to force the ink through the screen onto the workpiece to be printed upon in a pattern determined by art work formed on the screen.

Improved printing characteristics have been obtained by some screen printers by stiffening the squeegee with a metal support on the back side of the squeegee. The tendency of the squeegee rubber to be deflected and/or bent during the print stroke was decreased by the stiffness added by this metal plate behind the squeegee. By reducing the tendency of the squeegee rubber to bend or deflect away, the sharp edge of the squeegee is presented to the screen to "cut off" the ink more cleanly at the screen mesh line, thereby providing a more uniform squeegee function. One proposal is to adhere a rigid plastic backing to the squeegee blade to increase its stiffness.

Much of the screen printing today is done with automatic or semiautomatic screen printing equipment which may be used to print with various kinds of inks, through various kinds of screens, and onto various kinds of substrates. Thus, a squeegee in such equipment is subjected to varying printing conditions and there still is a need for a sharp edge to be presented to the screen to cut off the ink cleanly at the screen mesh line. Turning first to inks, many different types of printing inks are used in screen printing today and some of the inks, being more viscous than others, require a greater pressure on the squeegee to force a desired amount of ink through the screen. Also, temperature and humidity conditions may have some effect on the printing pressure, as will screen fabrics.

Also, the amount of ink applied to a workpiece varies with the surface characteristics of the workpiece material. Today, screen printing is used on a variety of workpiece materials, such as paper cardboard, but also cloth, metal, glass and ceramics. These may require widely varying printing pressures to assure printing patterns having the desired sharpness and detail. Also, there is the requirement of blade sharpening which is usually done with the clamp in position on the blade. Hence, devices which control the blade stiffness should not interfere with the blade sharpening operation.

SUMMARY OF THE INVENTION

It is therefore an object of the present invention to provide a printing blade assembly having a single resilient printing blade which is capable of adjustably altering the stiffness (i.e., resilience) of that blade upon demand, in a simple and easy manner.

Yet another object of the present invention is to provide printing blade assemblies of the above-described type which are formed from a minimum number of relatively inexpensive components.

Another object of the present invention is to provide printing blade assemblies of the above-described type which are suitable not only for manual printing operations but also automatic and semiautomatic screen printing machines.

These and other objects of the present invention which will become apparent from studying the appended description and accompanying drawings. The invention is provided in a squeegee assembly for use in screen printing, comprising in combination a resilient squeegee blade having a lower printing end with a leading edge for contacting a screen-like workpiece during a printing stroke. A holder is provided for mounting the blade, along with adjusting means for adjustably supporting the blade so that the stiffness thereof in resisting deflection during a printing stroke may be adjusted. In one embodiment, the adjusting means comprises front and back plates which are more rigid than the printing blade. Preferably, only the upper ends of the front and back plates are fastened to the holder, with the lower portions of the front and back plates engaging the vertical sides of the squeegee. Fastener means secure the front and back plates to the holder and clamp the upper portion of the blade therebetween, holding the blade captive during a printing stroke. The front and back plates are adjustably movable toward and away from the blade printing end. When lowered, the plates overlie greater portions of the blade and provide greater support for the blade against deflection as the blade is inclined and moved in a leading direction during a printing stroke. Thus, a sharp leading edge may be provided to the screen to cut off the ink more cleanly at the screen mesh line. As the adjustable plates are moved away from the blade printing end, the blade is allowed greater deflection in the trailing direction, thereby lessening its stiffness during a printing stroke. In one embodiment, front and back plates are moved in unison toward and away from the printing end of the blade.

BRIEF DESCRIPTION OF THE DRAWINGS

In the drawings wherein like elements are referenced alike.

DETAILED DESCRIPTION OF THE PREFERRED EMBODIMENT

Typically, a screen printing operation requires printing and flooding strokes in which the blade assembly is moved in opposite directions. The blade assemblies typically include a printing blade usually formed of rubber, elastomeric, or the like material and having a generally rectangular cross-sectional configuration at its bottom, printing end which has a leading edge to contact the screen to force ink therethrough during a printing stroke. During a printing stroke, the printing blade assembly is inclined toward the direction of blade travel, thereby bringing the leading edge of the blade printing end into contact with the screen, to force ink therethrough while the trailing edge of the blade is raised away from the screen.

During a flooding stroke, the blade assembly is typically returned to a near-vertical position or is slightly inclined in a direction opposite to the inclination during a printing stroke, so as to bring the trailing edge of the blade closer to the screen than the leading edge, to distribute ink over the surface of the screen. During a printing stroke, when the leading edge of the blade printing end contacts the screen, and the required pressure is applied to the blade assembly, the printing blade is deflected or bent toward its trailing edge. Squeegee blades must exhibit a certain amount of resilience in order to print well, but if the leading edge is deflected too much, the sharp corner of the blade may not be doing the desired cutting off of the ink at the screen mesh line. If greater pressure is required to force a desired amount of ink through the screen during a printing stroke, it may be desired that the stiffness of the blade be increased (i.e., its resilience reduced). The required stiffness of a blade is carefully selected for a particular printing job. On the other hand, for other jobs, the stiffness of the squeegee blade may be desired to be substantially less to achieve good printing results.

Figure 1:
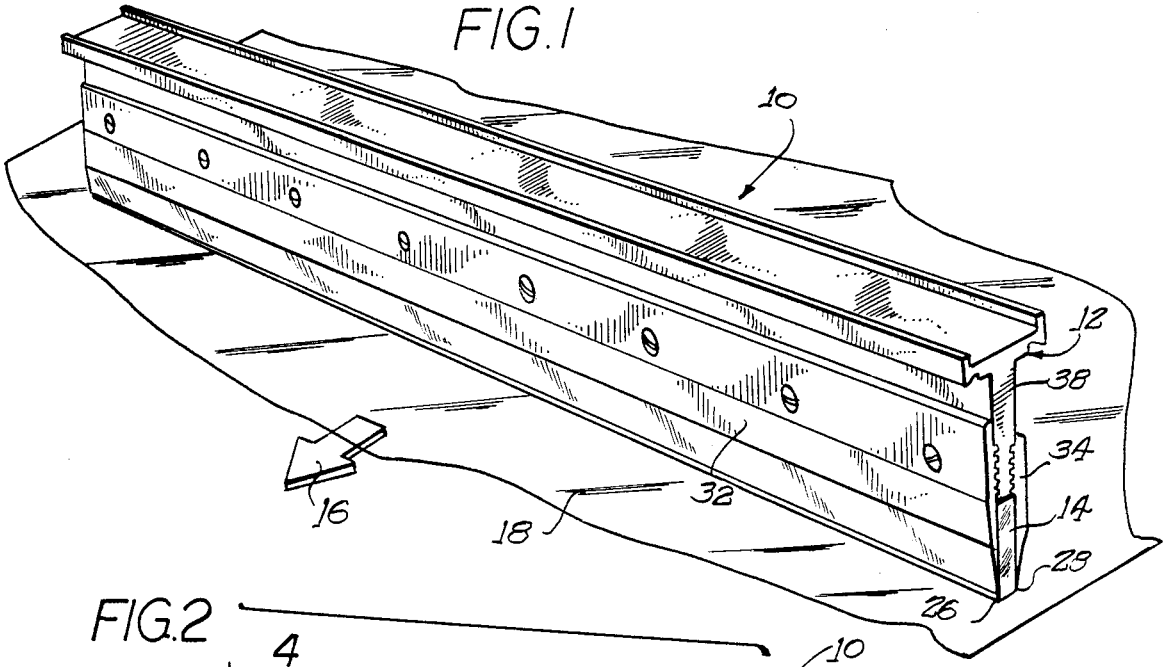
FIG. 1 is a perspective view of a squeegee and a squeegee holder illustrating aspects of the present invention.

Turning now to the drawings, a screen printing blade assembly is generally indicated at 10. The assembly 10 comprises a holder, generally indicated at 12, and a screen printing blade 14. As illustrated in FIG. 1, assembly 10 is shown in a printing stroke, being inclined in the direction of blade travel (i.e., leading direction) indicated by the arrow 16. Also shown in FIG. 1 is a fragment of a printing screen 18 through which ink is forced onto a workpiece located below the screen. As can be seen most clearly in FIGS. 4–6, blade 14 has a generally rectangular cross-sectional shape and includes an upper end 20 secured in holder 12 and a lower, printing end 22 which contacts the screen during a printing stroke. The printing end 22 of blade 14 has a forward or leading edge 26 and rearward or trailing edge 28 formed at its lower, outside corners. Thus, as seen in FIG. 4, when the printing assembly is inclined in the general direction of arrow 16, the leading edge 26 contacts the screen and the trailing edge 28 and the bottom blunt end of the blade 14 is generally raised or rotated out of contact with the screen.

Figure 4:
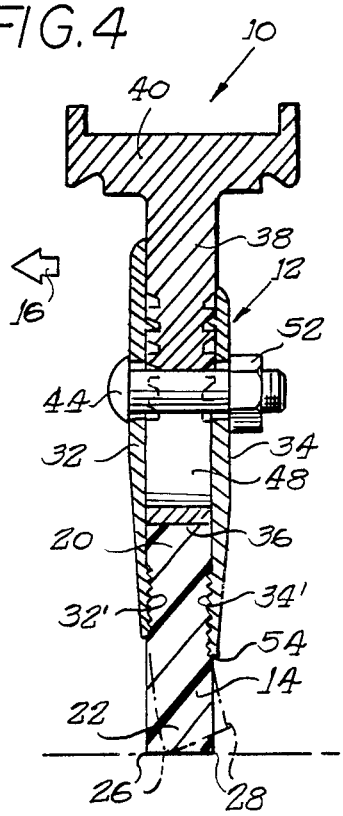
FIG. 4 is a cross-sectional view taken substantially along the line 4—4 of FIG. 2 and looking in the direction of the arrows.

Preferably, blade 14 is made of rubber elastomeric or a like resilient material which presents a sharp edge to the surface of the printing screen throughout the travel of the blade during a printing stroke, with pressures applied and because the blade is resilient, the bottom of the blade is deflectable in a trailing direction (opposite arrow 16) as indicated in phantom in FIG. 4. Frequently, a printing stroke must be accompanied by appreciable pressure on blade assembly to assure a sharp, even image throughout the entire printed pattern.

The deflection of the printing end of blade 14 is therefore the result of the blade resilience, downward pressure on the blade assembly and the frictional engagement with the screen as the blade assembly is moved in the leading direction of arrow 16 during a printing stroke. In the past, if blade assemblies of differing blade stiffnesses were desired, the blades were changed, which is an expensive and time-consuming process. Thus, there is a need that the stiffness of the printing blade can be varied without requiring the resilient blade to be exchanged or altered.

Figure 6:
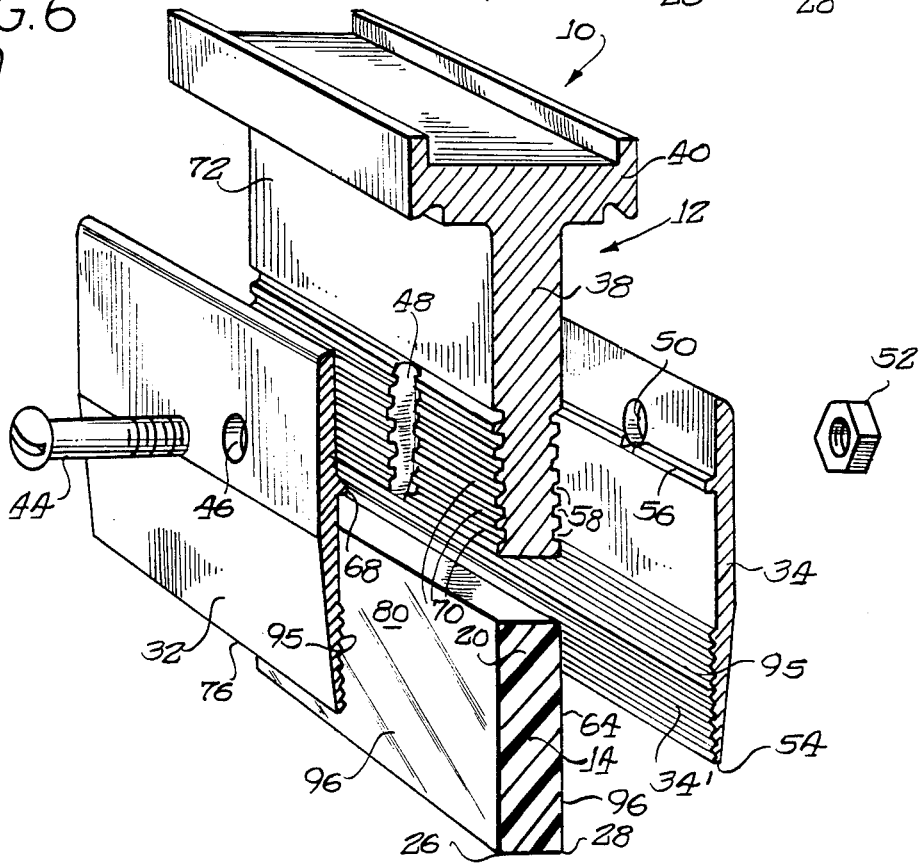
FIG. 6 is a fragmentary exploded view of the squeegee assembly of the preceding Figures.

In accordance with the present invention, the stiffness of the squeegee blade is adjusted by a selectively adjustable means cooperating with the holder and the blade. The preferred selectively-adjustable means includes a vertically movable clamp means comprising front and rear plates 32 and 34. The upper end 20 of blade 14 is mounted in a recess or channel-like opening between the front and back plates 32, 34 and the lower end 36 of a central holder portion 38. In the preferred embodiment illustrated in the figures, the central holder 38 is intricately formed with a mounting head 40 of a type suitable for mounting to the carriage of automatic or semiautomatic printing apparatus which moves the printing blade assembly 10 back and forth in printing and flooding strokes. The central holder portion 38 has a thickness generally corresponding to 0.40 inches, or slightly less than the thickness of blade 14 and provides a desired spacing between the inside blade-engaging surfaces 32', 34' of front and back plates 32, 34. With reference to FIG. 6, a plurality of screw fasteners 44 pass through apertures 46 in front plate 32, slotted apertures 48 in central holder portion 38, and apertures 50 in back plate 34, so that when mated with a threaded nut fastener 52, they provide a compressive or clamping force which draw the front and back plates 32, 34 together so as to clamp the upper end 20 of blade 14 therebetween. Thus, blade 14 is maintained in secure engagement with holder 12, particularly during the printing stroke, with engagement being maintained despite deflection of the printing end 22 of blade 14.

Referring now to FIGS. 2–5, the back plate 34 conveniently provides adjustable backing for printing blade 14, and particularly the printing end 22 thereof. As can be seen by. comparing the position of back plate 34 in FIGS. 4 and 5, the free end or bottom edge 54 thereof is adjustably movable toward and away from the printing end 22 of blade 14 and in particular, the trailing edge 28 thereof. With reference to FIG. 6, the back plate 34 is provided with an outwardly-projecting rib 56 which is receivable in any one of the several complementary recesses 58 formed in the trailing side 60 of central holder portion 38. Thus, by loosening the screw and nut fastener arrangement 44, 52, the rib 56 of back plate 34 can be located in upwardly or downwardly adjacent recesses 58, and upon subsequent tightening of the screw fastener, is locked in position thereat. Thus, it will be seen that serrated surfaces are formed and engaged between the holder and the front and back plates to resist slipping or turning of the plates relative to the holder body.

Figure 5:
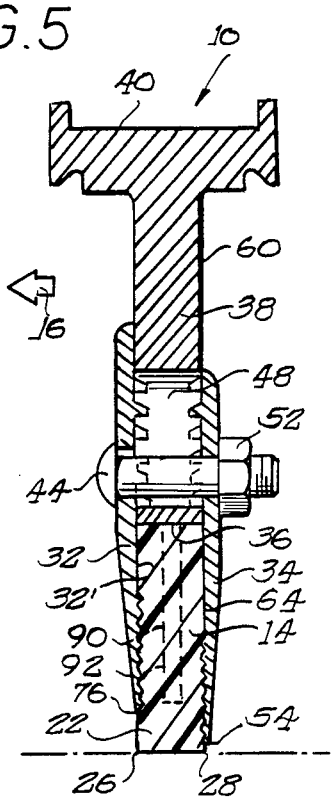
FIG. 5 is a cross-sectional view taken substantially along the line 5—5 of FIG. 3 and looking in the direction of the arrows.

In order to accommodate the vertical travel of screw fastener 44, the slots 48 in central holder portion 38 are preferably elongated in a vertical direction and have a length corresponding to the range of adjustment provided to the lower free edge 54 of central back plate 34. As shown in FIG. 5, back plate 34 is in a completely raised position, withdrawn a maximum amount away from the printing end of blade 14. This provides a minimum backing support to the blade, allowing a maximum deflection thereof under pressure. With the rib 56 located in lower recesses 58, the free end 54 of back plate 34 is advanced toward the printing end 22 of blade 14, thus providing increased backing support for blade 14. Specifically, a greater portion of the trailing surface 64 of blade 14 is supported against deflection in a trailing direction.

As mentioned above, the front plate 32 cooperates with central holder portion 38 and back plate 34 to provide a clamping force for mounting the upper end of blade 14. In order to provide greater control over the printing blade when back plate 34 is adjusted to various positions relative to the printing end of blade 14, front plate 32 is so mounted to be movable toward and away from the leading end of the blade. Accordingly, front plate 32 preferably has an outwardly projecting rib 68 receivable in a plurality of recesses 70 formed in the leading side 72 of central holder portion 38. Thus, as rib 68 is moved between upwardly and downwardly adjacent recesses 70, the free end 76 thereof is displaced toward and away from the printing end 22 of blade 14, in a manner similar to that of back plate 34. The front and back plates can therefore be moved up and down together in coordinated positions to assure the clamping force needed to retain blade 14 in holder 12 and to maintain the desired control over the deflection of the free end 22 of blade 14. For example, it has been found that control over the deflection of the blade printing end can be increased with an increase in blade stiffness if the free end 76 of front plate 32 is spaced close to but slightly above the free end 54 of back plate 34. Preferably, the vertical spacing between the free ends 76, 54 of front and back plates 32, 34, respectively, is fixed at a constant amount. Accordingly, the apertures in the plates 32, 34 provide a generally close fit with the threaded fastener 44, and the plates are moved in unison toward and away from the blade printing end.

The ribs 56, 68 are preferably horizontal, parallel, and continuous over the length of the plates 32 and 34. The back and front plates are preferably extruded from aluminum material, and hence, it is convenient to form continuous ribs over the length of the plates 32, 34. The ribs are sized to fit into the grooves 58 and 70 in the central holder portion 38.

Figure 2:
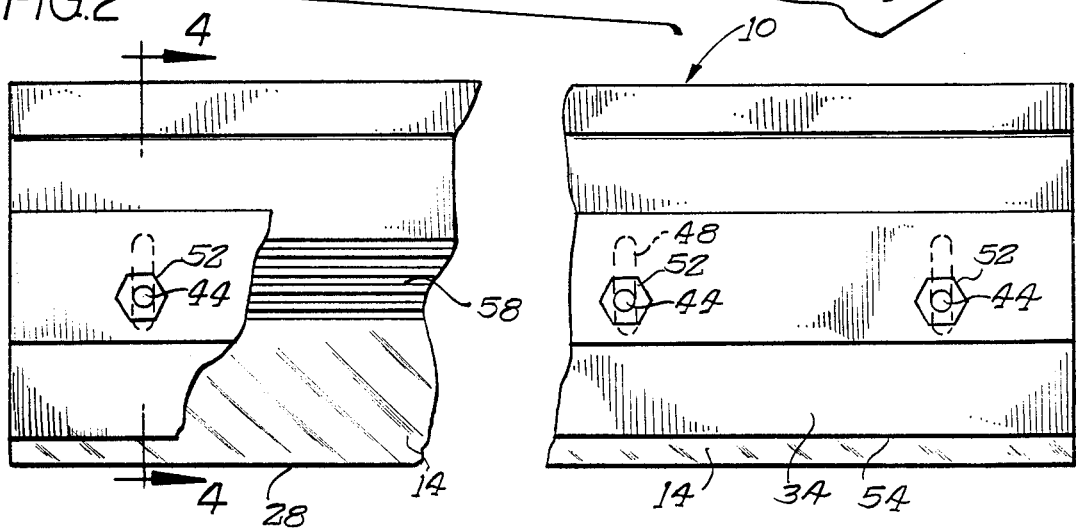
FIG. 2 is a fragmentary elevational view, shown partly broken away, of the squeegee assembly of FIG. 1, shown in minimum stiffness position.
Figure 3:
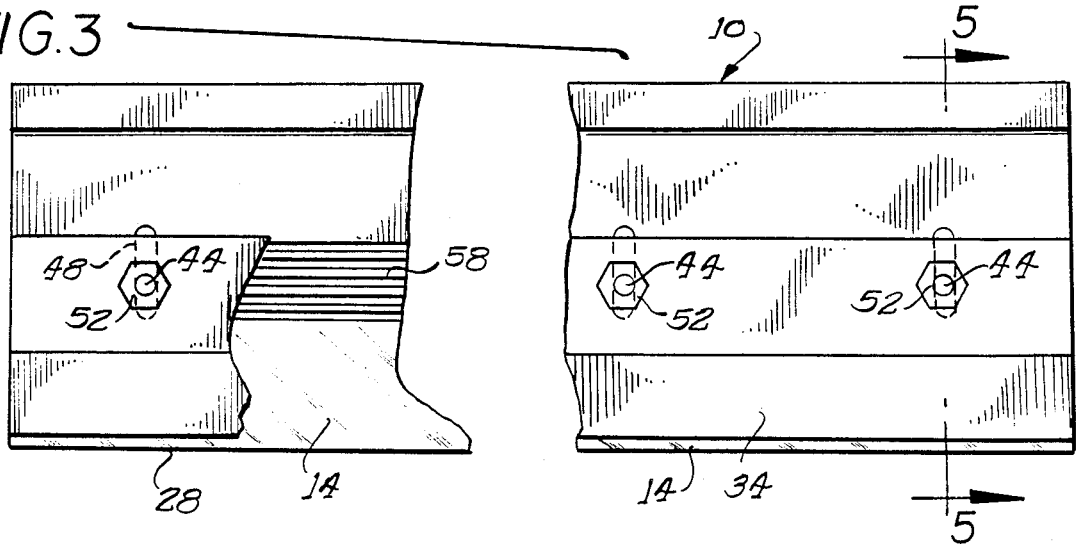
FIG. 3 is a fragmentary elevational view of the squeegee of the above Figures shown in maximum stiffness position.

Referring now to FIGS. 2–5 and in particular to FIGS. 2 and 3, operation of the invention will now be described. Assuming an initial operating condition of FIGS. 2 and 4, wherein a blade of only relatively little stiffness is required the front plate 32 and in particular, the back plate 34, are spaced a relatively longer distance away from the printing end 22 of blade 14. Accordingly, as illustrated in FIG. 2, the free end of back plate 34 is raised above the trailing edge 28 of blade 14 with a relatively large spacing. If an operator prefers greater blade stiffness, the printing blade assembly is readjusted by lowering the plates 32 and 34 to provide the desired stiffness. With the threaded fasteners 44, 52 throughout the length of the printing blade assembly being loosened, the protruding ribs 68, 56 of the front and back plates can be moved to lower recesses, so as to space the free end 54 of back plate 34 considerably closer to the trailing edge 28 of the blade printing end 22. With the back plate 34 in the closer position, printing blade 14 is supported against significant deflection during a printing stroke and is therefore able to apply a greater pressure to the screen at its leading edge 26 without the sharp edge of the squeegee being deflected away from the screen fabric.

Although the preferred method of altering the stiffness of printing blade 14 is accomplished by adjusting the height of back plate 34, with or without corresponding adjustment of front plate 32, other arrangements are possible and are contemplated by the present invention. For example, a vertically extending internal recess 90 can be located within the cross section of printing blade 14, as indicated in phantom in FIG. 5. The internal recess can receive a rigidifying plate therein, spaced at varying distances from the bottom 92 of the recess. With the rigidifying plate (not shown in the drawings) based farther away from the bottom 92 of recess 90, the blade exhibits a reduced stiffness during a printing stroke and is more easily deflected in a trailing direction, opposite to that of arrow of 16. As the internal rigidifying plate is moved closer to the bottom end 92 of recess 90, the blade exhibits greater stiffness and is therefore capable of operating at a greater downward pressure during a printing stroke. The internal recess and rigidifying plate can be used either with or without the front or back plates 32, 34. However, if the plates 32, 34 are eliminated, other means must be provided for mounting the blade 14 to central holder portion 38.

Referring to FIGS. 4–6 and especially to FIG. 6, the blade-engaging surfaces 32',34' of plates 32, 34 are preferably provided with serrated surfaces in the form of sawtooth projections and recesses 95, which aid the plate in maintaining a secure, captive engagement with the printing blade over a wide range of printing pressures. If desired, blade 14 may also be provided with sawtooth recesses (not shown) on its leading and trailing sides 80, 64. The serrated surfaces will bite into the elastomeric material of the blade and clamp the blade against shifting relative to the plates 32, 34 or relative to the holder 12. The lower outer surfaces of the plates 32 and 34 are smooth and tapered so that ink may be readily wiped therefrom by an operator who desires to clean any excess ink therefrom.

The holder 12 is preferably formed of extruded aluminum, although other materials can be used. Aluminum is generally preferred for its lightweight, rigid structure, particularly for the back plate 34 which, as can be seen in FIGS. 4–6, has a relatively thin cross section compared to its height. If materials other than aluminum are used for the back plate 34, it is important to choose a material which, for the desired dimensions of the back plate produces a backing member that is more rigid (i.e., less resilient) than the blade. Thus, it is not necessary that the backing member be totally inflexible, since moderately flexible backing members (such as certain plastics, for example) can stiffen more resilient squeegee blades when placed in a back-supporting relationship therewith.

It will be seen from the foregoing that the squeegee blade may be sharpened with the clamping means in place. That is, it is not necessary to remove the plates 32 and 34 in order to sharpen the lower edge of the squeegee blade.

In the preferred embodiment illustrated herein, the rear plate may be positioned with its lower edge located as low as the rear trailing edge of the squeegee blade; and at this time, the lower edge of the front plate will be spaced above the leading edge of the squeegee blade by a predetermined distance, usually within a range of $\frac{1}{4}$ to $\frac{3}{8}$ inch. Thus, it is preferred that the front plate never be lowered to the leading edge of the squeegee, but that the lower plate edge is always spaced above the lower edge of the rear plate by at least the predetermined spacing between lower edges of the plates, which is usually in the range of $\frac{1}{4}$ of $\frac{3}{8}$ inches.

It can therefore be seen that a printing blade assembly has been provided with features for adjusting the stiffness of a printing blade carried therein. Adjustments to blade stiffness can be quickly and easily performed without requiring dismantling of the printing equipment. As will now be appreciated, the objects hereinbefore set forth may readily and efficiently be attained and, since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A squeegee assembly comprising:

a squeegee blade having a body of a predetermined stiffness and having a lower end which deflects with pressure in use;

a leading edge on the squeegee blade for presenting to a screen fabric;

a squeegee holder for holding the squeegee blade; said holder maintaining the squeegee lower end at a fixed height relative to said holder with changes in the squeegee blade's resistance to deflection, a selectively adjustable means cooperating with the holder and the squeegee blade to adjust the stiffness of the lower portion of the squeegee blade to selectively limit the deflection of the leading edge due to pressure applied during use, said adjustable means including a front plate for engaging the front side of both the holder and the squeegee blade and a rear plate of engaging both the holder and the rear side of the squeegee blade, a lower edge on said front plate disposed above the leading edge of the squeegee blade, a lower edge on said rear plate offset by a fixed distance below the lower edge of the front plate, and means joining said front and rear plates to maintain the fixed offset distance between the lower edges of the front and rear blades, said front and rear plates being movable vertically as a unit along said blade to selectively limit the deflection of the leading edge of squeegee blade due to pressure applied during use without changing the height of the combined holder and squeegee blade assembly.

2. A squeegee assembly in accordance with claim 1 in which said squeegee holder comprises a central right holder having a lower edge abutting the top of the squeegee blade, and in which the means joining the front and rear plates comprises a fastener means extending through the central rigid holder and through the front and back plates.

3. A squeegee assembly in accordance with claim 2 in which elongated rib locking surfaces are formed between the front and rear plates and the holder to hold the plates in vertically adjusted positions and against tilting movement in an adjusted position relative to the holder.

4. A squeegee assembly in accordance with claim 3 in which the rib locking surfaces comprise a plurality of vertically spaced grooves on front and rear sides of the holder and at least one rib on the respective front and rear plates to fit into one of the grooves on the respective front and rear sides of the holder.

5. A squeegee assembly in accordance with claim 2 in which the holder has an elongated vertical slot therein and in which the fastener means comprises a threaded fastener extending through the elongated vertical slot for travel therein as the front and rear plates are shifted together as a unit relative to the holder to adjust the stiffness.

6. A squeegee unit for use in screen printing and having an adjustable resistance to deflection, said squeegee unit comprising:

a squeegee blade of substantially rectangular shape having an upper end and a lower end and front and rear sides, a holder having a lower wall for abutting the upper end of the squeegee blade and having front and rear sides, a rigid front plate having an upper portion disposed in face to face engagement with the front side of the holder and having a portion therebeneath engaging the front side of the squeegee blade in face-to-face relationship, a rigid rear plate having an upper portion disposed in face to face engagement with the rear side of the holder and having a portion therebeneath engaging the rear side of the squeegee, said squeegee blade and said holder together comprising a squeegee blade unit having a fixed height, said front and rear plates being movable vertically along the sides of the holder without changing the final height of the squeegee blade unit to adjust the stiffness of the lower end of the squeegee blade, and means to secure the front and rear plates to the holders and to clamp the front and rear plates to the squeegee blade.

7. A squeegee unit of a fixed vertical height and having an adjustable stiffness, said unit including:

a squeegee blade having an upper end and a lower end and having front and rear sides, a holder having an upper end for fastening to a carriage mounting head and having front and rear sides, a lower end on the holder attached to the upper end of the squeegee, a front plate spanning portions of the respective front sides of the holder and squeegee and movable between a plurality of vertical positions relative to the lower end of the squeegee blade, a rear plate spanning portions of the respective rear sides of the holder and squeegee and movable between a plurality of vertical positions relative to the lower end of the squeegee blade, an upper portion of the holder being located above the front and rear plates, said front and rear plates clamping the squeegee blade to the holder, and means to secure the front and rear plates to the holder at each of the plurality of adjusted vertical positions to change the stiffness of the lower edge of the squeegee to deflection during printing without changing said fixed vertical height of said squeegee unit.

8. A squeegee unit in accordance with claim 7 in which the front sides of the holder and the squeegee blade are generally parallel and the rear sides of the holder and squeegee are generally parallel, said front and rear plates having flat parallel surfaces in face to face engagement with the holder and squeegee blade parallel surfaces.

* * * * *

UNITED STATES PATENT AND TRADEMARK OFFICE

CERTIFICATE OF CORRECTION

PATENT NO. : 4,841,854

DATED : June 27, 1989

INVENTOR(S) : Henry J. Bubley

It is certified that error appears in the above-identified patent and that said Letters Patent is hereby corrected as shown below:

IN THE SPECIFICATION:

Column 2, line 4, delete "which".

Column 2, line 67, delete the comma.

Column 4, line 36, delete the period after "by".

Column 4, line 58, change "5" to --4--.

Column 6, line 8, delete "of" (second occurrence).

IN THE CLAIMS:

On column 7, Claim 1, line 19, change "a" to --and--.

On column 7, Claim 1, line 27, change "of" to --for--.

On column 8, Claim 6, line 13, change "face to face" to --face-to-face--.

On column 8, Claim 6, line 18, change "face to face" to --face-to-face--.

UNITED STATES PATENT AND TRADEMARK OFFICE

CERTIFICATE OF CORRECTION

PATENT NO. : 4,841,854

DATED : June 27, 1989

INVENTOR(S) : Henry J. Bubley

It is certified that error appears in the above-identified patent and that said Letters Patent is hereby corrected as shown below:

On column 8, Claim 6, line 25, change "final" to --fixed--.

On column 8, Claim 8, line 62-63, change "face to face" to --face-to-face--.

Signed and Sealed this

Eighth Day of May, 1990

*Attest:*

HARRY F. MANBECK, JR.

*Attesting Officer*

*Commissioner of Patents and Trademarks*